US006229254B1

(12) United States Patent
Matsudate et al.

(10) Patent No.: US 6,229,254 B1
(45) Date of Patent: May 8, 2001

(54) COLOR CATHODE RAY TUBE HAVING AN IMPROVED INTERNAL MAGNETIC SHIELD

(75) Inventors: Noriharu Matsudate, Sanbu-gun; Yasushi Sawatari; Atsuo Nakagawa, both of Mobara; Hidehiro Koumura, Goshogawara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/149,451

(22) Filed: Sep. 9, 1998

(30) Foreign Application Priority Data

Sep. 12, 1997 (JP) ..... 9-248715

(51) Int. Cl.[7] ..... H01J 29/80
(52) U.S. Cl. ..... 313/402; 313/479
(58) Field of Search ..... 313/402, 479, 313/421, 407, 403, 405, 406, 408

(56) References Cited

U.S. PATENT DOCUMENTS

| | | | | |
|---|---|---|---|---|
| 4,580,076 | * | 4/1986 | Shimoma et al. | 313/402 |
| 4,758,193 | * | 7/1988 | Brown | 445/1 |
| 5,363,010 | * | 11/1994 | Van Mensvoort | 313/402 |
| 6,020,678 | * | 2/2000 | Maehara | 313/402 |

FOREIGN PATENT DOCUMENTS

| | | |
|---|---|---|
| 3-57143 | 3/1991 | (JP) . |
| 3-71544 | 7/1991 | (JP) . |
| 4-188543 | 7/1992 | (JP) . |
| 4-298939 | 10/1992 | (JP) . |
| 5-159713 | 6/1993 | (JP) . |
| 5-159714 | 6/1993 | (JP) . |
| 5-174722 | 7/1993 | (JP) . |
| 6-119880 | 4/1994 | (JP) . |
| 6-124661 | 5/1994 | (JP) . |
| 6-310047 | 11/1994 | (JP) . |
| 7-65734 | 3/1995 | (JP) . |
| 7-105863 | 4/1995 | (JP) . |
| 7-147139 | 6/1995 | (JP) . |
| 11-115683 | 5/1996 | (JP) . |
| 8-287839 | 11/1996 | (JP) . |
| 9-27281 | 1/1997 | (JP) . |

* cited by examiner

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

A color cathode ray tube includes a magnetic shield of generally truncated pyramidal shape housed in its funnel portion and an electron beam deflection device. The magnetic shield is configured such that a magnetic shield-core distance between an end of a magnetic core of the deflection device facing toward the phosphor screen and an end of the magnetic shield facing toward the electron gun is approximately constant for section plane angles θ in a range of 0° to 360°, the magnetic shield-core distance being measured in a section plane containing a longitudinal axis of the cathode ray tube and being inclined at the section plane angle θ with respect to a horizontal scanning direction of the electron beams.

7 Claims, 6 Drawing Sheets

COLOR CATHODE RAY TUBE HAVING AN IMPROVED INTERNAL MAGNETIC SHIELD

BACKGROUND OF THE INVENTION

The present invention relates to a color cathode ray tube, and particularly to a color cathode ray tube having an internal magnetic shield with its shape modified to greatly reduce beam landing errors caused by an external magnetic field.

In general, a color cathode ray tube comprises an evacuated envelope (a glass bulb) formed of a panel portion having a faceplate, a neck portion and a funnel portion for connecting the panel portion and the neck portion, a phosphor screen formed on an inner surface of the faceplate which includes a multiplicity of phosphor elements of three colors, a shadow mask having a multiplicity of apertures therein and spaced from the phosphor screen in the panel portion, a three-beam in-line type electron gun housed in the neck portion for generating three electron beams and projecting the electron beams through the shadow mask to the phosphor screen, a magnetic shield of generally truncated pyramidal shape extending from the interior of the funnel portion into the panel portion and having openings on the shadow mask side thereof and the electron gun side thereof, and a deflection device mounted in a vicinity of a transition region between the funnel portion and the neck portion.

In operation of this type of a color cathode ray tube, when the electron beams emitted from the electron gun are subjected to an ambient magnetic field, particularly the earth's magnetic field in the path to the shadow mask, the electron beam slightly deviates from its intended trajectory depending upon the magnitude and direction of the earth's magnetic field and lands away from its intended landing position on the phosphor screen, resulting in a landing error.

FIG. 5 illustrates the mechanism of occurrence of such a landing error of the electron beam. As shown in FIG. 5, the electron beam 51 emitted from the electron gun (not shown) is bent in the intended direction by the deflecting action on the beam by the deflection yoke (not shown) from the center of deflection 0 in the intended direction, goes straight in that direction, passes through one of the beam apertures, 52A, in the shadow mask 52 and impinges upon the intended landing position P on the phosphor screen 53 formed on the inner surface of the faceplate 1A.

When the electron beam 51 is not subjected to any influence of external magnetic fields, the electron beam 51 travels the normal trajectory as indicated by a solid line in FIG. 5. But if the electron beam 51 is subjected to the influence of an external magnetic field, the electron beam 51 deviates slightly from its normal trajectory, travels a trajectory different from the normal trajectory as indicated by a broken line in FIG. 5 and consequently lands on the position P' displaced a distance $\Delta$ e from the intended landing position P on the phosphor screen 53, resulting in occurrence of a so-called beam landing error. The beam landing error deteriorates white uniformity and bright uniformity severely as well as color purity of a displayed image.

In practice, it is known that occurrence of the beam landing error in a color cathode ray tube can be suppressed by shielding the electron beam trajectories in the color cathode ray tube from the influence of external magnetic fields, specifically by employing a magnetic shield extending from the interior of the funnel portion into the panel portion. Now the magnetic shield is indispensable for color cathode ray tubes.

FIGS. 6A to 6C respectively are perspective views of different examples of magnetic shields which have been used for prior art cathode ray tubes. As shown in FIGS. 6A to 6C, magnetic shields 60 used for prior art cathode ray tubes are a magnetic shield of generally truncated pyramidal shape and have openings on the shadow mask side thereof and the electron gun side thereof.

While all their openings on the shadow mask side are rectangular with its entire edges of both the long and short sides contained in a single plane, the openings 61 on the electron gun side differ from shield to shield in FIGS. 6A to 6C. The four sides of the generally rectangular opening 61 on the electron gun side are level in the magnetic shield 60 of FIG. 6A, those in FIG. 6B are provided with V-notches, and those in FIG. 6C are provided with U-notches.

Even when an ambient magnetic field, especially the earth's magnetic field is present in a place where the color cathode ray tube is used, such a magnetic shield 60 produces a magnetic flux only through the material of the magnetic shield 60 made of a magnetic metal, and the interior of the magnetic shield 60 is shielded from the external (earth's) magnetic field and the electron beam traveling within the magnetic shield 60 is immune against the influence of the external (earth's) magnetic field. High-permeability materials are generally used for the magnetic shield 60 to effectively concentrate the external (earth's) magnetic field.

Recently, the demand for higher definition phosphor screens is becoming greater with the development of manufacturing technology of color cathode ray tubes, and the tolerance for beam landing on the phosphor elements is becoming considerably smaller with an increasing degree of the high definition. Consequently consideration has been required to a magnetic shield in the recent color cathode ray tubes to improve immunity against changing magnetic field environments.

As described above, magnetic shields 60 used for prior art cathode ray tubes have been of the generally truncated pyramidal shape. The four sides of their generally rectangular opening 61 on the electron gun side thereof have been level as shown in FIG. 6A, have been provided with V-notches as shown in FIG. 6B, or have been provided with U-notches as shown in FIG. 6C.

It can be thought that a magnetic circuit is formed by the magnetic shield 60 and the magnetic core of the deflection yoke mounted in the vicinity of the magnetic shield 60.

In this specification, a distance between an end of a magnetic core of the deflection device facing toward the faceplate and an end of the magnetic shield facing toward the plural-beam in-line type electron gun, which is measured in a section plane containing a longitudinal axis of the cathode ray tube and being inclined by an angle $\theta$ with respect to a horizontal scanning direction of the electron beams, is hereafter referred to merely as a magnetic shield-core distance D, and the angle $\theta$ is hereafter referred to as a section plane angle $\theta$.

The magnetic shield-core distance D is not approximately constant with variation of the section plane angle $\theta$ in magnetic shields 60 used for the prior art color cathode ray tubes. In FIG. 3, the rectangular curve and the circular curve indicate the relationship between the magnetic shield-core distance D and the section plane angle $\theta$ in the polar-coordinate form in color cathode ray tubes for a prior art shield 60 and an embodiment of a magnetic shield 7 of the present invention to be explained later, respectively. In FIG. 3, reference numeral 8B denotes the magnetic core of the deflection yoke.

In FIG. 3, the magnetic shield-core distances D measured at the center MH of the long (horizontal) side, at the center MV of the short (vertical) side, and at the corner of the generally rectangular opening on the electron gun side are represented by DHM, DVM, DC, respectively, in the prior art color cathode ray tube. The following inequality is satisfied: DHM<DVM<DC The magnetic shield-core distance D progressively increases from DHM toward DC as one goes from the center MH toward the corner and the magnetic shield-core distance D progressively increases from DVM toward DC as one goes from the center MV toward the corner.

When the magnetic shield-core distance D is not constant with variation of the section plane angle θ in magnetic shields 60 used for the prior art color cathode ray tubes, the magnetic resistance varies with the distance D, that is, with the section plane angle θ. The magnetic flux of the external magnetic field is concentrated at portions of low magnetic resistance, does not pass uniformly through the entire magnetic shield 60, the magnetic shield 60 is not expected to provide a sufficient shielding effect, the electron beam 51 is subjected to a slight influence of the external (earth's) magnetic field within the magnetic shield 60 and deviates slightly from its intended trajectory.

The prior art color cathode ray tube cannot be completely shielded from the external (earth's) magnetic field by its magnetic shield 60, the electron beam 51 (see FIG. 5) is subjected to the influence of the external magnetic field, deviates slightly from its intended trajectory, and moves slightly away from its intended landing position P to a position P' on the phosphor screen 53, resulting in occurrence of a landing error. In the prior art color cathode ray tube, the landing error causes a problem in that color purity, and consequently white uniformity or brightness uniformity of the displayed image deteriorate.

SUMMARY OF THE INVENTION

An object of the present invention is to solve the above-mentioned problems of the prior art and to provide a color cathode ray tube capable of suppressing occurrence of beam landing errors sufficiently by increasing the shielding effect against the external magnetic fields by the magnetic shield greatly.

To accomplish the above object, the magnetic shield of generally truncated pyramidal shape in a color cathode ray tube of the present invention is configured such that a magnetic shield-core distance between an end of a magnetic core of the deflection device facing toward the phosphor screen and an end of the magnetic shield facing toward the electron gun is approximately constant for section plane angles θ in a range of 0° to 360°, the magnetic shield-core distance being measured in a section plane containing a longitudinal axis of the cathode ray tube and being inclined at the section plane angle θ with respect to a horizontal scanning direction of the electron beams.

Further, to accomplish the above object, the magnetic shield of generally truncated pyramidal shape in a color cathode ray tube of the present invention can be configured so as to satisfy a following inequality, $$0.75\times Dave \leqq (Dmax+Dmin)/2 \leqq 1.25\times Dave,$$

where Dmax, Dmin, and Dave are respectively a maximum, a minimum, and an average of magnetic shield-core distances between an end of a magnetic core of the deflection device facing toward the faceplate and an end of the magnetic shield facing toward the plural-beam in-line type electron gun, the magnetic shield-core distances being measured in a section plane containing a longitudinal axis of the cathode ray tube and being inclined at the section plane angle θ with respect to a horizontal scanning direction of the electron beams.

For the purpose of simplifying the design of the magnetic shield, Dave can be set to be ( Dverm+Dhorm+Dcor)/3, where Dverm and Dhorm are the magnetic shield-core distances measured at the section plane angles 0°, 180° (horizontal section plane) and 90°, 270° (vertical section plane), respectively, and Dcor are the magnetic shield-core distance measured in the section plane intersecting a corner of the generally rectangular end of the magnetic shield facing toward the electron gun.

Further, to accomplish the above object, the magnetic shield of generally truncated pyramidal shape in a color cathode ray tube of the present invention can be configured so as to satisfy following inequalities, $$0.5\times Dave \leqq Dmin, \text{ and } Dmax \leqq Dave\times 1.5,$$

where Dmax, Dmin, and Dave are respectively a maximum, a minimum, and an average of magnetic shield-core distances between an end of a magnetic core of the deflection device facing toward the faceplate and an end of the magnetic shield facing toward the plural-beam in-line type electron gun, the magnetic shield-core distances being measured in a section plane containing a longitudinal axis of the cathode ray tube and being inclined at the section plane angle θ with respect to a horizontal scanning direction of the electron beams.

For the purpose of simplifying the design of the magnetic shield, Dave can be set to be (Dverm+Dhorm+Dcor)/3, where Dverm and Dhorm are the magnetic shield-core distances measured at the section plane angles 0°, 180° (horizontal section plane) and 90°, 270° (vertical section plane), respectively, and Dcor are the magnetic shield-core distance measured in the section plane intersecting a corner of the generally rectangular end of the magnetic shield facing toward the electron gun.

According to the present invention, a magnetic resistance of a magnetic circuit formed by a magnetic shield and a magnetic core of the deflection yoke mounted in the vicinity of the magnetic shield is approximately constant, or is held to be varying within a range in which the influence of the external magnetic field is substantially suppressed, along the entire circumference of the faceplate side end of the magnetic core, the flux produced by the external field pass approximately uniformly through the entire magnetic shield and the magnetic shield provides a sufficient shielding effect against the external magnetic field.

As a result the electron beam is immune against the influence of the external magnetic field and occurrence of beam landing errors can be suppressed sufficiently.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
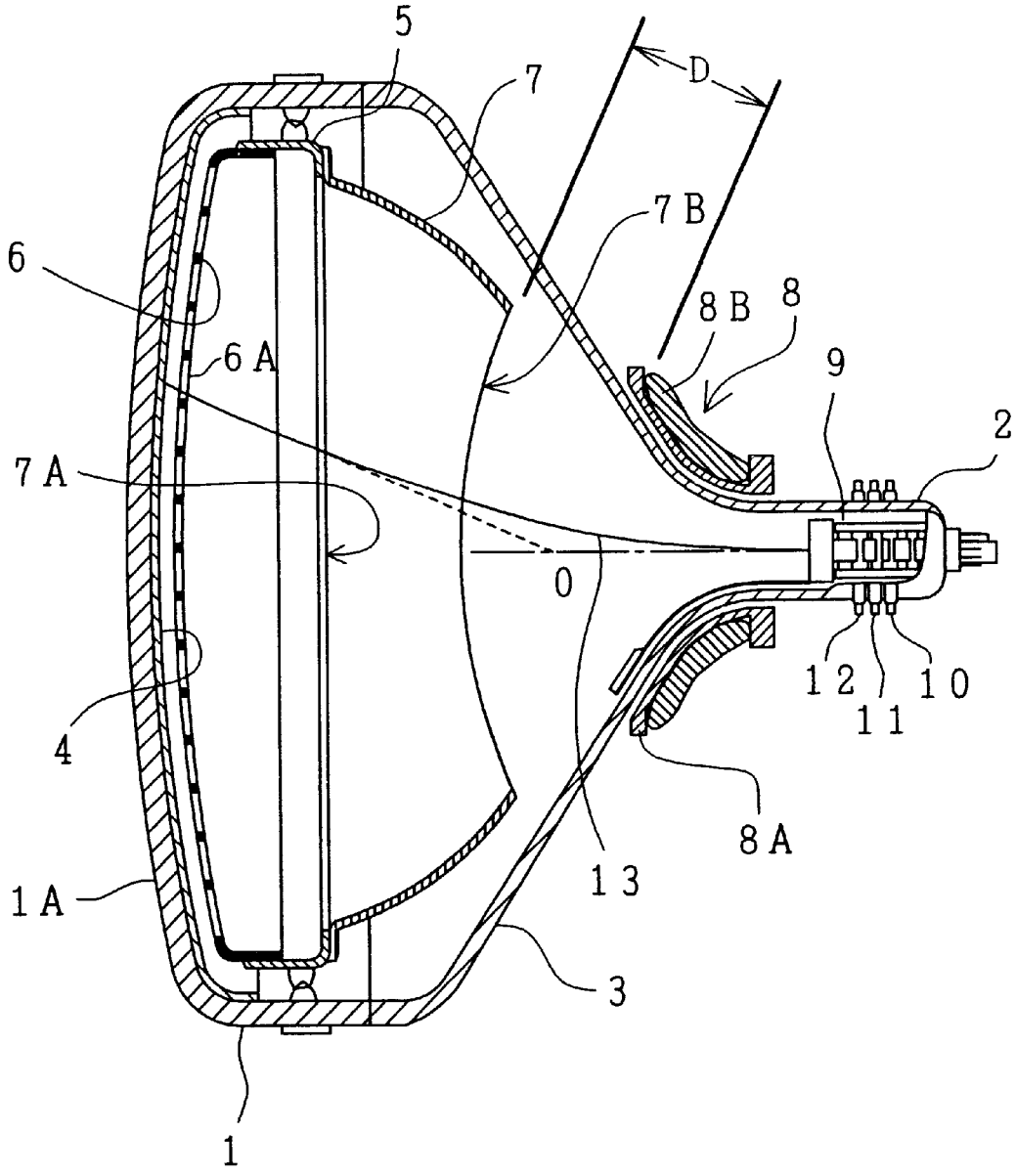
FIG. 1 is a schematic cross sectional view of an embodiment of a color cathode ray tube of the present invention.

In an embodiment of the present invention, a color cathode ray tube comprises an evacuated envelope comprising a panel portion, a neck portion and a funnel portion for connecting the panel portion and the neck portion, the panel portion including a faceplate, a phosphor screen formed on an inner surface of the faceplate, the phosphor screen including a multiplicity of phosphor elements of three colors, a shadow mask having a multiplicity of apertures therein and spaced from the phosphor screen in the panel portion, a three-beam in-line type electron gun housed in the neck portion for generating three electron beams and projecting the electron beams through the shadow mask to the phosphor screen, a magnetic shield of generally truncated pyramidal shape housed in the funnel portion, and a deflection device mounted in a vicinity of a transition region between the funnel portion and the neck portion for scanning the electron beams on the phosphor screen, wherein the magnetic shield is configured such that a magnetic shield-core distance between an end of a magnetic core of the deflection device facing toward the faceplate and an end of the magnetic shield facing toward the three-beam in-line type electron gun is approximately constant for section plane angles θ in a range of 0° to 360°, the magnetic shield-core distance being measured in a section plane containing a longitudinal axis of the cathode ray tube and being inclined at the section plane angle θ with respect to a horizontal scanning direction of the plurality of electron beams.

In another embodiment of the present invention, a color cathode ray tube comprises an evacuated envelope comprising a panel portion, a neck portion and a funnel portion for connecting the panel portion and the neck portion, the panel portion including a faceplate, a phosphor screen formed on an inner surface of the faceplate, the phosphor screen including a multiplicity of phosphor elements of three colors, a shadow mask having a multiplicity of apertures therein and spaced from the phosphor screen in the panel portion, a three-beam in-line type electron gun housed in the neck portion for generating a plurality of electron beams and projecting the electron beams through the shadow mask to the phosphor screen, a magnetic shield of generally truncated pyramidal shape housed in the funnel portion, and a deflection device mounted in a vicinity of a transition region between the funnel portion and the neck portion for scanning the electron beams on the phosphor screen, wherein the magnetic shield is configured so as to satisfy a following inequality, $$0.75\times Dave \leqq (Dmax+Dmin)/2 \leqq 1.25\times Dave,$$

where Dmax, Dmin, and Dave are respectively a maximum, a minimum, and an average of magnetic shield-core distances between an end of a magnetic core of the deflection device facing toward the faceplate and an end of the magnetic shield facing toward the three-beam in-line type electron gun, the magnetic shield-core distances being measured in a section plane containing a longitudinal axis of the cathode ray tube and being inclined at the section plane angle θ with respect to a horizontal scanning direction of the electron beams.

For the purpose of simplifying the design of the magnetic shield, Dave can be set to be (Dverm+Dhorm+Dcor)/3, where Dverm and Dhorm are the magnetic shield-core distances measured at the section plane angles 0°, 180° (horizontal section plane) and 90°, 270° (vertical section plane), respectively, and Dcor are the magnetic shield-core distance measured in the section plane intersecting a corner of the generally rectangular end of the magnetic shield facing toward the electron gun.

In another embodiment of the present invention, a color cathode ray tube comprises an evacuated envelope comprising a panel portion, a neck portion and a funnel portion for connecting the panel portion and the neck portion, the panel portion including a faceplate, a phosphor screen formed on an inner surface of the faceplate, the phosphor screen including a multiplicity of phosphor elements of three colors, a shadow mask having a multiplicity of apertures therein and spaced from the phosphor screen in the panel portion, a three-beam in-line type electron gun housed in the neck portion for generating three electron beams and projecting the electron beams through the shadow mask to the phosphor screen, a magnetic shield of generally truncated pyramidal shape housed in the funnel portion, and a deflection device mounted in a vicinity of a transition region between the funnel portion and the neck portion for scanning the electron beams on the phosphor screen, wherein the magnetic shield is configured so as to satisfy following inequalities, $$0.5\times Dave \leqq Dmin, \text{ and } Dmax \leqq Dave\times 1.5,$$

where Dmax, Dmin, and Dave are respectively a maximum, a minimum, and an average of magnetic shield-core distances between an end of a magnetic core of the deflection device facing toward the faceplate and an end of the magnetic shield facing toward the three-beam in-line type electron gun, the magnetic shield-core distances being measured in a section plane containing a longitudinal axis of the cathode ray tube and being inclined at the section plane angle θ with respect to a horizontal scanning direction of the plurality of electron beams.

For the purpose of simplifying the design of the magnetic shield, Dave can be set to be (Dverm+Dhorm+Dcor)/3, where Dverm and Dhorm are the magnetic shield-core distances measured at the section plane angles 0°, 180° (horizontal section plane) and 90°, 270° (vertical section plane), respectively, and Dcor are the magnetic shield-core distance measured in the section plane intersecting a corner of the generally rectangular end of the magnetic shield facing toward the electron gun.

In these embodiments, the shape of the electron gun side opening of the magnetic shields is configured such that the magnetic shield-core distance D as defined above is approximately constant or held within a specified range for all section plane angles θ, and consequently a magnetic resistance of a magnetic circuit formed by the magnetic shield and a magnetic core of the deflection yoke mounted in the vicinity of the magnetic shield is approximately constant, or is held to be varying within a range in which the influence of the external magnetic field is substantially suppressed, along the entire circumference of the faceplate side end of the magnetic core, the flux produced by the external field pass approximately uniformly through the entire magnetic shield and the magnetic shield provides a sufficient shielding effect against the external magnetic field. As a result the electron beam is immune against the influence of the external magnetic field, does not deviate from its intended trajectory, occurrence of beam landing errors can be suppressed sufficiently, and color purity, white uniformity or brightness uniformity do not deteriorate in the displayed image.

The specific embodiments of the present invention will be explained in detail hereunder with reference to the accompanying drawings.

FIG. 1 is a schematic cross sectional view of an embodiment of a color cathode ray tube of the present invention. In FIG. 1, reference numeral 1 is a panel portion, 1A is a faceplate, 2 is a neck portion, 3 is a funnel portion, 4 is a phosphor screen, 5 is a support frame, 6 is a shadow mask, 7 is a magnetic shield, 7A is an opening of the magnetic shield 7 on the shadow mask side thereof, 7B is an opening of the magnetic shield 7 on the electron gun side thereof, 8 is a deflection yoke, 8A is a coil of thedeflection yoke, 8B is a magnetic core of the deflection yoke, 9 is an electron gun, 10 is a purity adjustment magnet, 11 is a static convergence adjustment four-pole magnet, 12 is a static convergence adjustment six-pole magnet, 13 is an electron beam, and 0 is a deflection center of the electron beam 13.

The evacuated envelope (glass bulb) of the color cathode ray tube is comprised of the panel portion 1 having a faceplate 1A on its front, the narrow tubular neck portion 2 for housing the electron gun 9 therein and the funnel portion 3 for connecting the panel portion 1 and the neck portion. The panel portion 1 includes the phosphor screen 4 coated on the inner surface 1A of the faceplate 1A and houses the support frame 5 attached to the inner sidewall thereof. The shadow mask 6 is supported at its periphery by the support frame 5 such that its useful area opposes the phosphor screen 4. The magnetic shield 7 of generally truncated pyramidal shape is supported at its shadow mask side opening 7A by the support frame 5 to extend from the interior of the panel portion 1 to the interior of the funnel portion 3.

The magnetic shield 7 is provided with the shadow mask side opening 7A on one side of its generally truncated pyramidal shape and is provided with the electron gun side opening 7B on the other side thereof. The deflection yoke 8 is comprised of the magnetic core 8B and the coil 8A incorporated into the magnetic core 8A, and is mounted around the neighborhood of the junction of the funnel portion 3 and the neck portion 2. There are the color purity adjustment magnet 10, the static convergence adjustment four-pole magnet 11 and the static convergence adjustment six-pole magnet 12 juxtaposed around the neck portion 2. The three electron beams (only one of which is shown) 13 emitted from the electron gun 9 are deflected in their intended direction by the deflection yoke 8, pass through the interior of the magnetic shield 7, through their intended aperture 6A in the useful area of the shadow mask 6, and impinge upon the phosphor screen 4.

The image displaying operation of the color cathode ray tube in these embodiments is substantially the same as that of a prior art color cathode ray tube of this type, is well known in the field of this technology and therefore, explanation thereof is omitted.

Figure 2A:
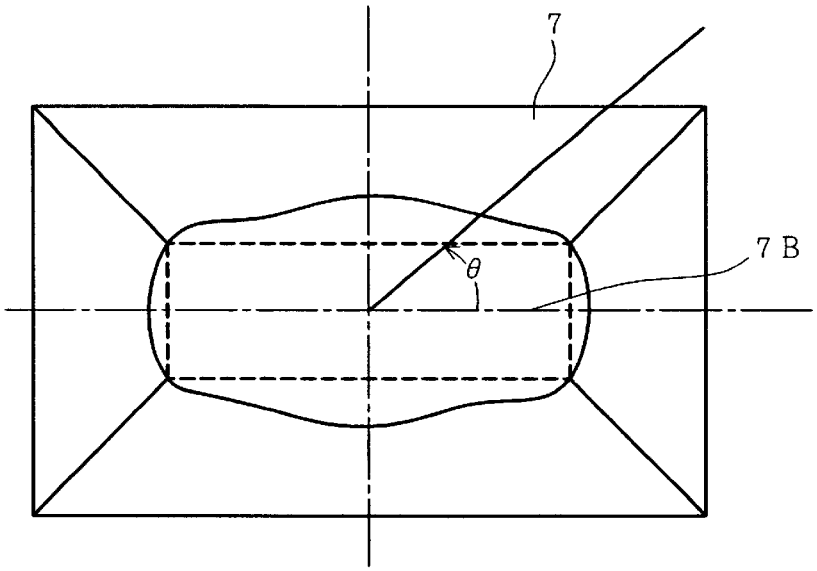
FIGS. 2A to 2C are respectively structural views showing an example of a magnetic shield used for the color cathode ray tube shown in FIG. 1, FIG. 2A being a top view thereof, FIG. 2B being a side view of a long side (a horizontal side) thereof, and FIG. 2C being a side view of a short side ( a vertical side) thereof.
Figure 2B:
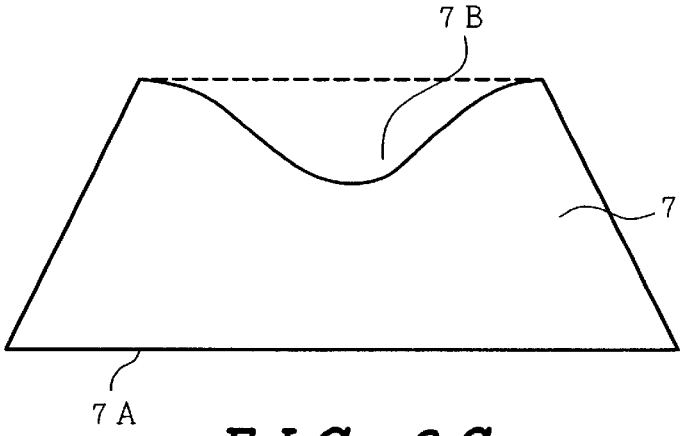
Figure 2C:
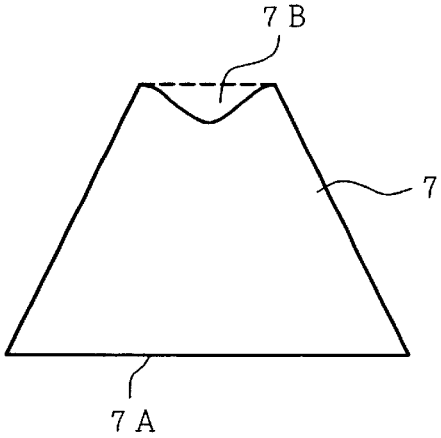

FIGS. 2A to 2C are respectively structural views showing an example of the magnetic shield 7 used for the color cathode ray tube of the present embodiment shown in FIG. 1, FIG. 2A being a top view thereof, FIG. 2B being a side view of a long side (a horizontal side) thereof, and FIG. 2C being a side view of a short side (avertical side) thereof. The same reference numerals as utilized in FIG. 1 designate corresponding portions in FIGS. 2A to 2C.

As shown in FIGS. 2A to 2C, the magnetic shield 7 is of the generally truncated pyramidal shape, has a generally rectangular large-diameter opening 7A on the shadow mask side thereof and has a generally rectangular small-diameter opening 7B having sloped cutouts provided in the intermediate portions of its long and short sides on the electron gun side thereof as explained below.

In this embodiment, the sloped cutouts provided in the intermediate of the long and short sides of the electron gun side opening 7B are configured such that a magnetic shield-core distance D is approximately constant for all section plane angles θ°.

Figure 3:
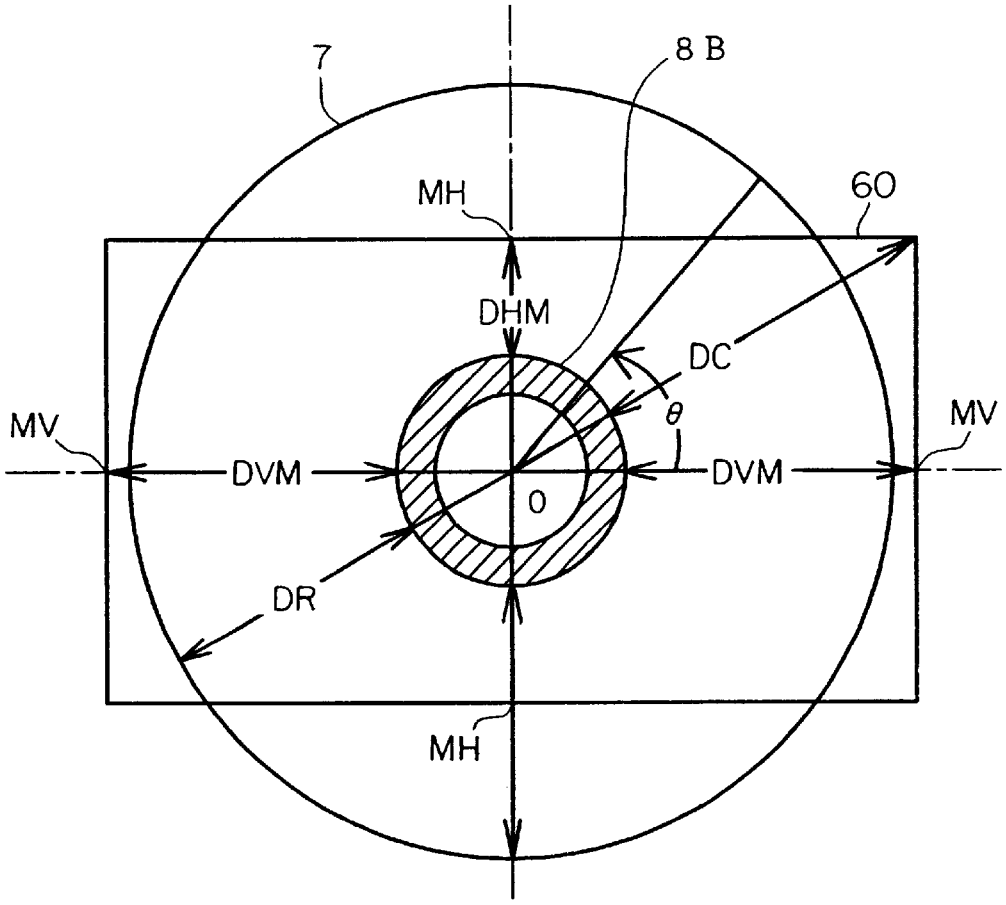
FIG. 3 is a illustration of a comparison of the relationship between a magnetic shield-core distance D and a section plane angle θ in the polar-coordinate form for color cathode ray tubes of the present invention and the prior art.

FIG. 3 is an illustration of a comparison of the relationship between a magnetic shield-core distance D and a section plane angle θ in the polar-coordinate form for color cathode ray tubes of the present invention and the prior art. The rectangular curve and the circular curve indicate the relationship between the magnetic shield-core distance D and the section plane angle θ in color cathode ray tubes for the prior art shield 60 and an embodiment of the magnetic shield 7 of the present invention, respectively.

By using the magnetic shield 7 of this embodiment, as the circular curve shows in FIG. 3, the magnetic shield-core distance D becomes an approximately uniform value DR along the entire circumference of the faceplate side end of the magnetic core 8B and the magnetic resistance of a magnetic circuit formed by the magnetic shield 7 and the magnetic core 8B is approximately constant along the entire circumference of the faceplate side end of the magnetic core 8B.

As a result, even if the color cathode ray tube of this embodiment is in the external (earth's) magnetic field, the magnetic shield 7 exhibits an approximately uniform magnetic resistance, the magnetic flux produced by the external (earth's) magnetic field pass through the material of the magnetic shield 7 and the magnetic shield 7 can provide a sufficient shielding effect against the external (earth's) magnetic field. Consequently, the electron beam 13 is immune against the influence of the external (earth's) magnetic field within the color cathode ray tube of this embodiment, the electron beam 13 does not deviate from the intended trajectory and occurrence of beam landing errors is sufficiently suppressed. The color cathode ray tube of this embodiment can reduce deterioration of color purity and white uniformity or brightness uniformity greatly.

Figure 4:
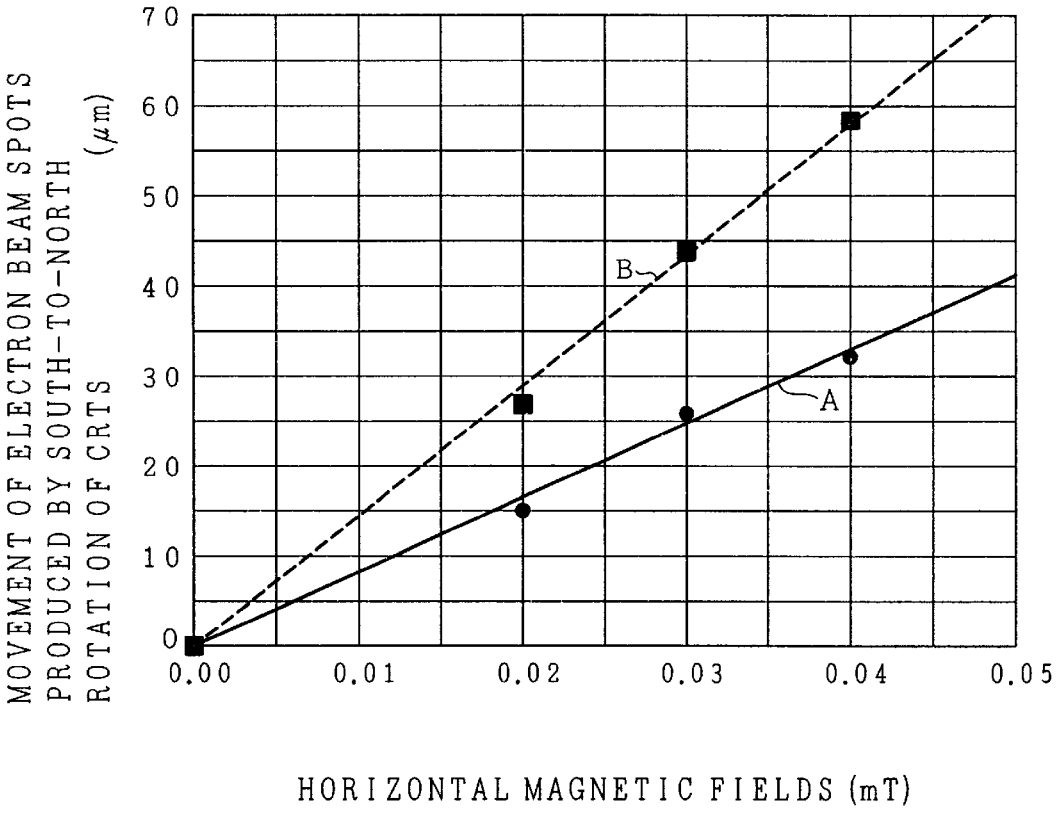
FIG. 4 is a graph showing a comparison of the relationship between the movement of electron beam spots and the horizontal external magnetic field for color cathode ray tubes of the present invention and the prior art.
Figure 5:
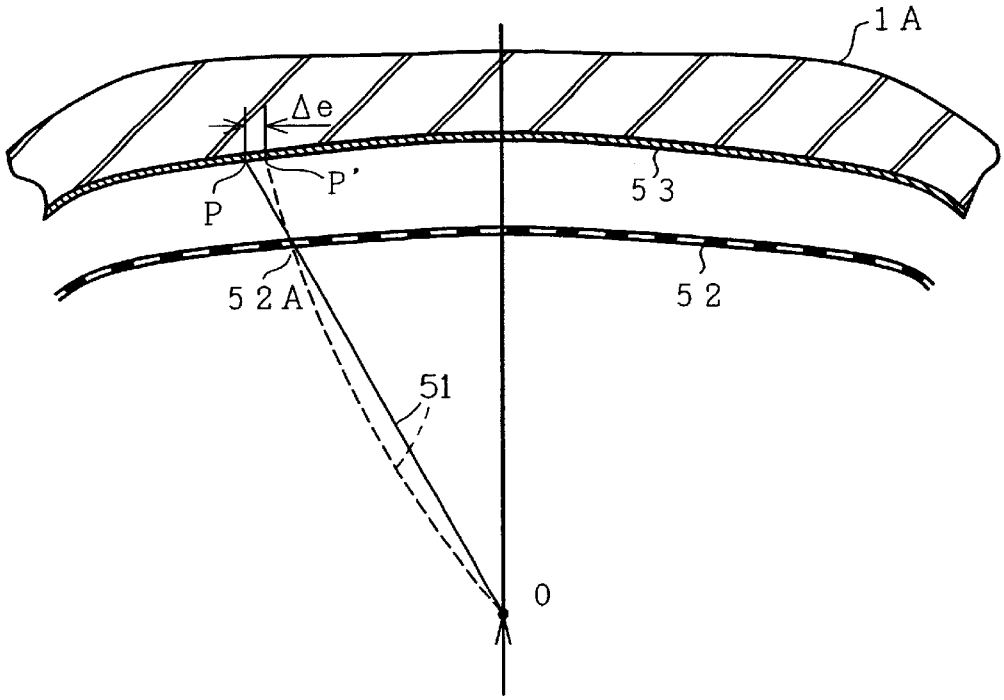
FIG. 5 (PRIOR ART)
FIG. 5 illustrates the mechanism of occurrence of a landing error of the electron beam.
Figure 6A:
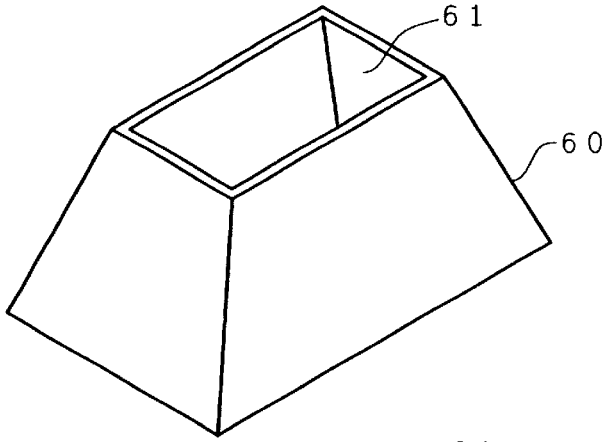
FIG. 6A (PRIOR ART)
FIGS. 6A to 6C respectively are perspective views of different examples of magnetic shields used for prior art cathode ray tubes.
Figure 6B:
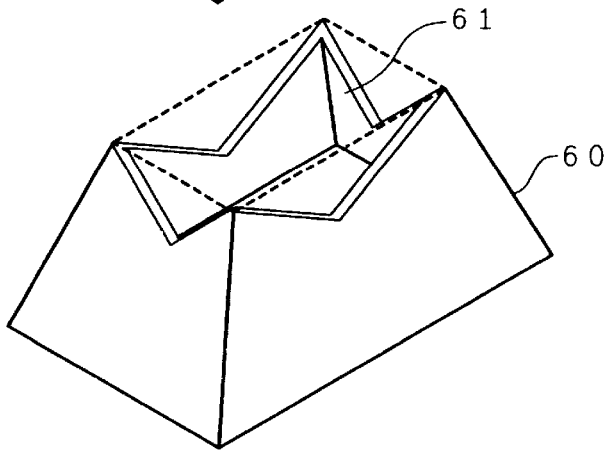
FIG. 6B (PRIOR ART)
Figure 6C:
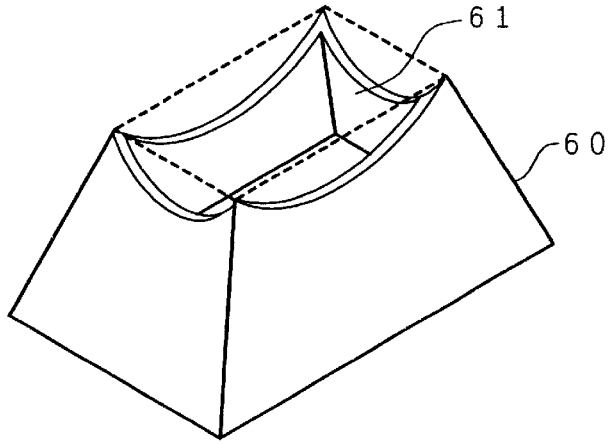
FIG. 6C (PRIOR ART)

FIG. 4 shows a relationship between the change in the movement of electron beam spots (see FIG. 1) and the horizontal external magnetic fields experimentally and horizontally applied to a color cathode ray tube of this embodiment by the curve A. The curve B shows the characteristics of the prior art color cathode ray tube for the purpose of comparison.

The change in the movement of the electron beams increases with increasing external magnetic fields for both the color cathode ray tubes of this embodiment and the prior art as represented by the curves A and B, respectively, in FIG. 4. The rate of increase of the change in the movement of the electron beam spots by the electron beam 13 with the increase of the strength of the external magnetic fields in the color cathode ray tube of this embodiment is about half that in the color cathode ray tube of the prior art. This shows the shielding effect against the external magnetic field by the magnetic shield 7 in the color cathode ray tube of the this embodiment is greatly superior to that by the magnetic shield 60 in the color cathode ray tube of the prior art.

In this embodiment, the sloped cutouts provided in the intermediate of the long and short sides of the electron gun side opening 7B are configured such that a magnetic shield-core distance D becomes an approximately constant value for all section plane angles θ. The shape of the cutouts provided in the intermediate of the long and short sides of the electron gun side opening 7B in the present invention is not limited to that in the above embodiment, but can be the shapes as described below.

In another embodiment of the present invention, a color cathode ray tube comprises an evacuated envelope comprising a panel portion, a neck portion and a funnel portion for connecting the panel portion and the neck portion, the panel portion including a faceplate, a phosphor screen formed on an inner surface of the faceplate, the phosphor screen including a multiplicity of phosphor elements of three colors, a shadow mask having a multiplicity of apertures therein and spaced from the phosphor screen in the panel portion, a three-beam in-line type electron gun housed in the neck portion for generating three of electron beams and projecting the electron beams through the shadow mask to the phosphor screen, a magnetic shield of generally truncated pyramidal shape housed in the funnel portion, and a deflection device mounted in a vicinity of a transition region between the funnel portion and the neck portion for scanning the electron beams on the phosphor screen, wherein the magnetic shield can be configured so as to satisfy a following inequality, $$0.75\times Dave \leqq (Dmax+Dmin)/2 \leqq 1.25\times Dave,$$

where Dmax, Dmin, and Dave are respectively a maximum, a minimum, and an average of magnetic shield-core distances between an end of a magnetic core of the deflection device facing toward the faceplate and an end of the magnetic shield facing toward the three-beam in-line type electron gun, the magnetic shield-core distances being measured in a section plane containing a longitudinal axis of the cathode ray tube and being inclined at the section plane angle θ with respect to a horizontal scanning direction of the electron beams.

For the purpose of simplifying the design of the magnetic shield, Dave can be set to be (Dverm+Dhorm+Dcor)/3, where Dverm and Dhorm are the magnetic shield-core distances measured at the section plane angles 0°, 180° (horizontal section plane) and 90°, 270° (vertical section plane), respectively, and Dcor are the magnetic shield-core distance measured in the section plane intersecting a corner of the generally rectangular end of the magnetic shield facing toward the electron gun.

In another embodiment of the present invention, a color cathode ray tube comprises an evacuated envelope comprising a panel portion, a neck portion and a funnel portion for connecting the panel portion and the neck portion, the panel portion including a faceplate, a phosphor screen formed on an inner surface of the faceplate, the phosphor screen including a multiplicity of phosphor elements of three colors, a shadow mask having a multiplicity of apertures therein and spaced from the phosphor screen in the panel portion, a three-beam in-line type electron gun housed in the neck portion for generating three electron beams and projecting the electron beams through the shadow mask to the phosphor screen, a magnetic shield of generally truncated pyramidal shape housed in the funnel portion, and a deflection device mounted in a vicinity of a transition region between the funnel portion and the neck portion for scanning the electron beams on the phosphor screen, wherein the magnetic shield can be configured so as to satisfy following inequalities, $$0.5\times Dave \leqq Dmin, \text{ and } Dmax \leqq Dave\times 1.5,$$

where Dmax, Dmin, and Dave are respectively a maximum, a minimum, and an average of magnetic shield-core distances between an end of a magnetic core of the deflection device facing toward the faceplate and an end of the magnetic shield facing toward the three-beam in-line type electron gun, the magnetic shield-core distances being measured in a section plane containing a longitudinal axis of the cathode ray tube and being inclined at the section plane angle θ with respect to a horizontal scanning direction of the electron beams.

For the purpose of simplifying the design of the magnetic shield, Dave can be set to be (Dverm+Dhorm+Dcor)/3, where Dverm and Dhorm are the magnetic shield-core distances measured at the section plane angles 0°, 180° (horizontal section plane) and 90°, 270° (vertical section plane), respectively, and Dcor are the magnetic shield-core distance measured in the section plane intersecting a corner of the generally rectangular end of the magnetic shield facing toward the electron gun.

Further, by configuring the magnetic shield such that Dcor is Dmin, occurrence of beam landing errors can be effectively suppressed. This is because the magnetic shielding effect is enhanced by reduction of the magnetic resistance and resultant concentration of magnetic fluxes in the corners of the magnetic shield related to the corners of the phosphor screen where large beam landing errors are apt to occur.

In the above two embodiments, the magnetic resistance of a magnetic circuit formed by a magnetic shield and a magnetic core of the deflection yoke mounted in the vicinity of the magnetic shield is held to be varying within a range in which the influence of the external magnetic field is substantially suppressed, the flux produced by the external field pass approximately uniformly through the entire magnetic shield and the magnetic shield provides a sufficient shielding effect against the external magnetic field.

As described above, in the present invention, the shape of the electron gun side opening of the magnetic shield is configured such that the magnetic shield-core distance D as defined above is approximately constant or held within a specified range in which the influence of the external magnetic field is substantially suppressed, for all section plane angles θ, and consequently the magnetic resistance of a magnetic circuit formed by the magnetic shield and the magnetic core of the deflection yoke is approximately constant, or is held to be varying within a range in which the influence of the external magnetic field is substantially suppressed, for all section plane angles θ, the flux produced by the external field pass approximately uniformly through the entire magnetic shield and the magnetic shield provides a sufficient shielding effect against the external magnetic field.

As a result, the electron beam is immune against the influence of the external magnetic field within the color cathode ray tube, does not deviate from its intended trajectory, occurrence of beam landing errors can be suppressed sufficiently, and color purity, white uniformity or brightness uniformity do not deteriorate in the displayed image.

What is claimed is:

1. A color cathode ray tube comprising an evacuated envelope comprising a panel portion, a neck portion and a funnel portion for connecting said panel portion and said neck portion, said panel portion including a faceplate, a phosphor screen formed on an inner surface of said faceplate, said phosphor screen including a multiplicity of phosphor elements of a plurality of colors, a shadow mask having a multiplicity of apertures therein and spaced from said phosphor screen in said panel portion, a plural-beam in-line type electron gun housed in said neck portion for generating a plurality of electron beams and projecting said plurality of electron beams through said shadow mask to said phosphor screen, a magnetic shield of generally truncated pyramidal shape housed in said funnel portion, and a deflection device mounted in a vicinity of a transition region between said funnel portion and said neck portion for scanning said plurality of electron beams on said phosphor screen, wherein said magnetic shield is configured such that a magnetic shield-core distance between an end of a magnetic core of said deflection device facing toward said faceplate and an end of said magnetic shield facing toward said plural-beam in-line type electron gun is approximately constant for section plane angles θ in a range of 0° to 360°, said magnetic shield-core distance being measured in a section plane containing a longitudinal axis of said cathode ray tube and being inclined at said section plane angle θ with respect to a horizontal scanning direction of said plurality of electron beams.

2. A color cathode ray tube comprising an evacuated envelope comprising a panel portion, a neck portion and a funnel portion for connecting said panel portion and said neck portion, said panel portion including a faceplate, a phosphor screen formed on an inner surface of said faceplate, said phosphor screen including a multiplicity of phosphor elements of a plurality of colors, a shadow mask having a multiplicity of apertures therein and spaced from said phosphor screen in said panel portion, a plural-beam in-line type electron gun housed in said neck portion for generating a plurality of electron beams and projecting said plurality of electron beams through said shadow mask to said phosphor screen, a magnetic shield of generally truncated pyramidal shape housed in said funnel portion, and a deflection device mounted in a vicinity of a transition region between said funnel portion and said neck portion for scanning said plurality of electron beams on said phosphor screen, wherein said magnetic shield is configured so as to satisfy a following inequality, $$0.75\times Dave \leqq (Dmax+Dmin)/2 \leqq 1.25\times Dave,$$

where Dmax, Dmin, and Dave are respectively a maximum, a minimum, and an average of magnetic shield-core distances between an end of a magnetic core of said deflection device facing toward said faceplate and an end of said magnetic shield facing toward said plural-beam in-line type electron gun, said magnetic shield-core distances being measured in a section plane containing a longitudinal axis of said cathode ray tube and being inclined at said section plane angle θ with respect to a horizontal scanning direction of said plurality of electron beams.

3. A color cathode ray tube according to claim 2, wherein said Dave is (Dverm+Dhorm+Dcor)/3, where Dverm and Dhorm are magnetic shield-core distances measured at section plane angles 0° and 90°, respectively, and Dcor are a magnetic shield-core distance measured in a section plane intersecting a corner of a generally rectangular end of said magnetic shield facing toward said electron gun.

4. A color cathode ray tube according to claim 3, wherein said Dmin is said Dcor.

5. A color cathode ray tube comprising an evacuated envelope comprising a panel portion, a neck portion and a funnel portion for connecting said panel portion and said neck portion, said panel portion including a faceplate, a phosphor screen formed on an inner surface of said faceplate, said phosphor screen including a multiplicity of phosphor elements of a plurality of colors, a shadow mask having a multiplicity of apertures therein and spaced from said phosphor screen in said panel portion, a plural-beam in-line type electron gun housed in said neck portion for generating a plurality of electron beams and projecting said plurality of electron beams through said shadow mask to said phosphor screen, a magnetic shield of generally truncated pyramidal shape housed in said funnel portion, and a deflection device mounted in a vicinity of a transition region between said funnel portion and said neck portion for scanning said plurality of electron beams on said phosphor screen, wherein said magnetic shield is configured so as to satisfy following inequalities, $$0.5\times Dave \leqq Dmin, \text{ and } Dmax \leqq Dave\times 1.5,$$

where Dmax, Dmin, and Dave are respectively a maximum, a minimum, and an average of magnetic shield-core distances between an end of a magnetic core of said deflection device facing toward said faceplate and an end of said magnetic shield facing toward said plural-beam in-line type electron gun, said magnetic shield-core distances being measured in a section plane containing a longitudinal axis of said cathode ray tube and being inclined at said section plane angle θ with respect to a horizontal scanning direction of said plurality of electron beams.

6. A color cathode ray tube according to claim 5, wherein said Dave is (Dverm+Dhorm+Dcor)/3, where Dverm and Dhorm are magnetic shield-core distances measured at section plane angles 0° and 90°, respectively, and Dcor are a magnetic shield-core distance measured in a section plane intersecting a corner of a generally rectangular end of said magnetic shield facing toward said electron gun.

7. A color cathode ray tube according to claim 6, wherein said Dmin is said Dcor.

* * * * *